US005960722A

United States Patent [19]

Kiss

[11] Patent Number: 5,960,722

[45] Date of Patent: Oct. 5, 1999

[54] METHOD OF OPERATING A HIGH-TEMPERATURE REACTOR FOR TREATMENT OF WASTE MATERIAL

[75] Inventor: Günter H. Kiss, Minusio, Switzerland

[73] Assignee: Thermoselect AG, Lieschtenstein, Germany

[21] Appl. No.: 08/800,232

[22] Filed: Feb. 12, 1997

[30] Foreign Application Priority Data

Feb. 16, 1996 [DE] Germany ..... 196 05 810

[51] Int. Cl.[6] ..... F23G 5/12

[52] U.S. Cl. ..... 110/229; 110/218

[58] Field of Search ..... 110/229, 218

[56] References Cited

U.S. PATENT DOCUMENTS 5,788,723 8/1998 Kiss ..... 48/197

FOREIGN PATENT DOCUMENTS 2628966 1/1978 Germany .
4130416 12/1992 Germany .
19512249 11/1996 Germany .

*Primary Examiner*—Henry Bennett
*Assistant Examiner*—Malik N. Drake
*Attorney, Agent, or Firm*—Howard & Howard

[57] ABSTRACT

The invention relates to a method of operating a high-temperature reactor for treating heterogeneous waste materials, in which the waste materials are introduced via an intake point into the reactor and form beneath the intake point a loose-piled gasification bed, in which the inorganic or organic components are subjected to fusion or gasification and homogenisation by oxygen and above the intake point the gaseous gasification products are subjected to high-temperature treatment with added oxygen in order to form and stabilise synthesis gas, water-cooled oxygen lances being used for high-temperature treatment.

13 Claims, No Drawings

METHOD OF OPERATING A HIGH-TEMPERATURE REACTOR FOR TREATMENT OF WASTE MATERIAL

The invention relates to a method of operating a high-temperature reactor for treating waste materials, in which these waste materials, such for example as domestic and/or industrial wastes, are subjected to a high-temperature treatment in a reactor, specially aligned oxygen lances being used for high-temperature treatment not only of the gaseous and liquid components but also of the solid components.

The most various methods and devices for high-temperature treatment of waste materials such as domestic and industrial wastes of all types are known from prior art. A method in which the waste materials of all types are firstly condensed and then, proceeding from this point, all the further process steps such as drying, de-gasification, gasification and melting are carried out without interruption, is known in specialist circles under the title "Thermoselect process" (DE 41 30 416, and literature source of Gunther Hasler: "Thermoselect, the new way of treating residual wastes in an environmentally appropriate manner" Verlag Karl Goerner, Karlsruhe, 1995).

In this method, the thermally pre-treated waste materials are continuously introduced via an intake point into the high-temperature reactor. The waste materials thermally pre-treated in this manner form a gas-permeable pile in the reactor itself. By means of the addition of oxygen or of air enriched with oxygen to the piled column of the gasification bed, the carbon ingredients present are oxidised or gasified at the temperatures of more than 2000° C. obtaining in the core of the gasification bed. The $CO_2$ occurring is reduced in a moderation chamber above the pile, i.e. in the top region of the high-temperature reactor, above the gasification bed, at temperatures of at least 1200° C., predominantly forming CO. At these temperatures the reaction equilibrium (producer-gas equilibrium) is moved towards CO. Due to the moisture in waste also introduced into the high-temperature reactor, the reaction $H_2O+C \rightarrow C_O+H_2$ (water gas reaction) takes place in parallel with the producer-gas equilibrium reaction. The synthesis gas resulting in all, which is extremely economically usable in terms of material and/or energy, at such temperature guidance predominantly consists of CO, $H_2$ and small quantities of $CO_2$. Organic contaminants, in particular also the highly toxic dioxins or furanes, are no longer stable in the temperature range in question and are reliably cracked. The metallic and/or mineral components of the waste on the other hand are fused in the lower burner zone and are withdrawn from the high-temperature reactor.

Provision is also made for homogenisation of the melted-down inorganic components with simultaneous separation of the minerals from the metals with phase separation in a temperature range of approximately 1600° C. to above 2000° C., before the melted and homogenised inorganic components harden after shock cooling with water jets. Cracking of the contaminants in the free gas space, the so-called moderation chamber above the gasification bed of the high temperature reactors, requires at that point precisely defined temperature conditions in each chamber sector, and specific delay times.

There are in particular two conditions which can impair the process. Firstly due to the possible extremely variable waste composition (above all with a high moisture content), the temperature of the synthesis gas in the delay chamber above the gasification bed can drop temporarily, and secondly, in the delay chamber above the gasification bed, laminar flow areas can form, which reduce the delay time of the synthesis gas for partial areas. This so-called lane or lane skein formation must under all circumstances be avoided in the moderation chamber. In both cases it cannot be excluded that traces of contaminants will remain in the synthesis gas and be released when it is exploited.

The possibility that ungasified carbon, for example in the form of fine particles brought in, will be located in the synthesis gas in the moderation chamber should be mentioned, in order to provide grounds for the necessity of secondary gasification in the gas chamber.

It is known from DE 195 12 249.6 that for the method described above for melting down the inorganic components, specially-designed oxygen lances are used. These oxygen lances are equipped with a permanently burning pilot flame with a high flame temperature and a high combustion speed in such a way that the lance oxygen is accelerated at least approximately to the speed of sound. This is intended to achieve an improvement in melting. However, it is insufficient, in order to solve all problems occurring in the high temperature reactor, above all for optimising the process configurations in the moderation area above the pile, to improve only the conditions in the pile beneath the intake point.

The high-temperature treatment of waste materials is subject to exacting demands due to the heterogeneity of the supplied waste. Even the lances described above cannot provide complete assistance here, so that no optimal operating conditions for operating such a high-temperature reactor could be achieved with these lances, in particular with respect to the gasification in the upper reactor portion.

Proceeding from this point the object of the present invention is therefore further to develop the method described in detail above in such a way that as far as possible optimum conversion both of the inorganic and of the gaseous components can be achieved.

It is in particular also an object of the invention reliably to exclude loading of the synthesis gases with organic contaminants, and to improve the quality of the mineral residues.

Thus it is proposed according to the invention to carry out both high-temperature gasification of the gasifiable components in the upper region of the reactor, and also to carry out melting or fusion of the inorganic components in the lower part of the reactor by means of oxygen lances, the oxygen lances in the lower area being so aligned that they reinforce the flow direction of the melting or fused inorganic components, and in the upper region in such a way that they are opposed to the flow direction of the gasification components, so that an inhibition occurs. The combination of combustion/oxygen lance is preferably so designed that a partial quantity of the oxygen necessary for combustion of the heating gas flows through the oxygen lances. In this way the nozzle of the lance, exposed to the highest temperature, is continuously cooled by this oxygen flow, even if no lance oxygen were necessary. By means of this measure the burner is protected from damage or from fouling of the UV monitoring glass, the back flow or diffusion of the pressurised gas of the high-temperature reactor being excluded in the interior of the oxygen lance, where otherwise an explosive mixture forms when the lance is out of operation.

By virtue of the fact that, in the upper area of the reactor, i.e. above the intake point, the oxygen lances are disposed contrary to the flow direction of the gasifying component, i.e. the ascending flow of the synthesis gases is braked, their delay time in the moderation zone is increased, so that both secondary gasification of any carbon components still brought in becomes possible, and the decomposition of all organic contaminants is ensured.

The oxygen lances, oriented in the flow direction of the mineral and metal components to be melted out within the pile in the reactor area beneath the intake point, at that point favour the desired separation of components, particularly when oxygen is used at a high flow velocity.

By virtue of the fact that oxygen is additionally introduced into the moderation zone in the form of a free gas chamber of the high-temperature reactor, under temperature control in such partial quantities, the temperature at this point can be kept absolutely constant by a partial combustion of the synthesis gas. The introduction of additional oxygen in addition offers the opportunity of subjecting the gas flow in the high temperature area to turbulence in such a way that laminar flow areas, which can form the so-called "through roads" for contaminants, no longer occur. An additional turbulence can be achieved in a simple way in that a plurality of oxygen nozzles for introducing the partial quantity of oxygen are used, which are axially and/or radially inclined. By means of the use of the oxygen lances in conjunction with turbulence of the gasifiable components, at the same time partially on- or incompletely-gasified components are likewise ubjected to gasification. It has become apparent that in operation of the reactor it cannot be excluded that there can be carried into the upper reactor portion, along with the pure gaseous components, also such components which are not yet or are only partially gasified. These components are now subjected to turbulence by the alignment of the lances according to the invention, are taken up and oxidatively converted and gasified by the supplied oxygen lances. In this way the combustion process is further optimised and progressed in the direction of a total formation of synthesis gas. It has become apparent that by means of this alignment according to the invention of the oxygen lances, not only does a "secondary gasification" of partially still ungasified or not-yet-completely gasified components takes place, but there also occurs, simultaneously under these operational conditions, a cracking of residual traces of organic contaminants still present in the gasification area. This also further contributes to optimum formation of synthesis gas. For high-temperature gasification at least two oxygen lances are aligned in the way described above. Naturally it is also possible to provide more than two oxygen lances; a number of the oxygen lances can have an alignment which is different from that described above. For this purpose the oxygen lances need not be disposed in one plane; they may rather be spatially distributed over the gasification area.

If oxygen lances with at least one permanently burning adjustable pilot flame are used, the temperature necessary for removal of contaminants can in every case be maintained, independently of other parameters.

These oxygen lances are preferably stoichiometrically operated with synthesis gas inherent in the process, or even with externally-supplied fuels, so that they can be adjusted to the minimum temperature necessary for the respective high-temperature treatment. For high-temperature gasification, the reactor space above the intake point is kept at greater than 1000° C. Dimensions of the reactor space are such that up to the reactor outlet there remains a delay time sufficient for adjustment of the equilibrium ratio, until the synthesis gas is shock cooled in order to avoid the new formation of organic compounds.

The oxygen lances in the lower area, i.e. for fusion or melting down of the inorganic components, are aligned according to the invention in such a way that they reinforce the flow direction of the outflowing melt. Here also it is necessary according to the present invention that at least two lances be aligned in this direction. The procedure in this case is preferably such that a plurality of lances are provided to follow the contour of the ellipsoid reactor base. The lances used for this purpose substantially correspond to the lances known from DE 195 12 249.6. Therefore express reference is made to the disclosed content of this document. The essential factor is that the lance oxygen is accelerated at least approximately to the speed of sound, so that it is also capable of penetrating with sufficient pressure into the inorganic components to be fused or melted down. Due to the high velocity, clogging of the oxygen lance is also prevented. This high-temperature treatment is preferably carried out at temperatures beneath 2000° C.

In a further development there is provision, in addition to the oxygen lances described above, to dispose further burners in the homogenisation area, in the region of fusion and melting-down. In the method according to the invention there is provision to design the area for homogenisation in such a way that an almost complete homogenisation of the fused inorganic components can be effected. In support there is provision for disposing in the homogenising portion of the reactor at the outlet end additional burners, these burners not necessarily being fitted with oxygen lances, but being possibly burners of a previously known type. These burners are so disposed that they are aligned contrary to the flow direction of the outflowing melt. This achieves a situation in which any solid agglomerates still present are forced back by the aligned burner or are prevented from flowing, so that there is a sufficiently long delay time to achieve a fusion and thus homogenisation also of these residual solid agglomerates still present. According to the invention, therefore the shock-type cooling of the melt for hardening by means of water jets is undertaken only when, in the way described above, complete homogenisation of the melt has occurred.

If at least one burner is operated in the area of melt homogenisation in a manner leaner than stoichiometric, i.e. with excess oxygen, then homogenisation takes place in an oxidising atmosphere. The stability of the melted-out minerals is improved in this way by secondary oxidation.

In the method according to the invention, the supply of oxygen to the oxygen lances and/or the supply of fuel to the pilot flames is regulated in dependence on the calorific value of the waste materials in such a way that in each case an almost constant synthesis gas composition and/or quantity results. This procedure thus compensates for differing calorific values of the waste materials supplied via the inlet aperture. As already shown in prior art, the method according to the invention also proceeds from heterogeneous wastes. The calorific values of heterogeneous wastes however vary very intensely, as on the one hand the waste can contain a large number or organic components and thus have a high calorific value, or more inorganic components or moisture, thus having a lower calorific value. In the method according to the invention the procedure is such that, at the outlet on the gas side, the composition of the synthesis gas mixture is respectively determined, and the oxygen supply to the oxygen lances is regulated in dependence on the calorific value, i.e. the oxygen lances are operated in such a way that a constant synthesis gas composition is achieved at the gas outlet.

I claim:

1. Method of operating a high-temperature reactor for treating heterogeneous waste materials including industrial, special and domestic wastes, in which the waste materials are separately and simultaneously thermally pre-treated and compressed and introduced into the reactor via an intake point, and form beneath the intake point a loose, piled gasification bed, in which the components are subjected by oxygen to a fusion or gasification and homogenisation, and above the intake point the gaseous gasification products are subject to high-temperature treatment with supplied oxygen in order to form and stabilize synthesis gas, characterized in that water-cooled oxygen lances are used for high-temperature treatment, at least two oxygen lances being disposed beneath the intake point to reinforce the flow direction of the fusing and melted-down waste materials, and at least two oxygen lances being disposed above the intake point to inhibit the flow of the ascending gaseous.

2. Method according to claim 1, characterized in that the oxygen, under temperature control, is introduced into the free gas space of the high-temperature reactor which is formed in a known way as a delay zone, in such quantities that partial combustion of the synthesis gas rendered possible in this way maintains the temperature above the gasification bed constantly above 1000° C., and in that the introduction of oxygen is such that it leads to turbulence in the gases, eliminating the formation of lanes or skeins, and a total homogeneous gas mixture is ensured.

3. Method according to claim 1, characterized in that additional heat is supplied to the high-temperature reactor in order to maintain the minimum temperatures of the thermal processes in such a way that oxygen lances are used which have at least one permanently burning pilot flame which is operated by synthesis gases inherent in the process and/or externally-supplied fuels, in a stoichiometric manner.

4. Method according to claim 1, characterized in that the oxygen lances are operated in such a way that gasification of partially non- or partially incompletely-gasified components is effected and/or in that residual traces of organic contaminants are cracked out of the gasification process.

5. Method according to claim 4, characterized in that the high-temperature treatment is carried out at temperatures greater than 1000° C.

6. Method according to claim 1, characterized in that the lance oxygen of the oxygen lances disposed beneath the intake point is accelerated to at least approximately the speed of sound.

7. Method according to claim 1, characterized in that a partial quantity of the combustion oxygen flows continuously through the oxygen lances so that the nozzle of the lance is cooled by this oxygen flow and is protected from fouling, even if no lance oxygen were necessary.

8. Method according to claim 7, characterized in that the high-temperature treatment is carried out at temperatures up to above 1600° C.

9. Method according to claim 1, characterized in that the reaction chamber above the intake point is of such large dimensions that a sufficient delay period remains before the gas outlet to set the equilibrium ratio, until the synthesis gas is shock cooled in order to prevent the new formation of organic compounds.

10. Method according to claim 1, characterized in that the reactor is designed beneath the intake point in such a way that at the outlet end it has a homogenisation area of such dimensions as will enable total homogenisation and phase separation of the outflowing melt, before this latter cools and hardens.

11. Method according to claim 10, characterized in that the temperature in the homogenisation area is held at greater than 1500° C. by means of at least one additional burner, at least one burner being so aligned that its flame is directed contrary to the flow direction of the outflowing melt.

12. Method according to claim 11, characterized in that at least one burner is used whose flame is operated in a manner leaner than stoichiometric in such a way that an oxidising atmosphere obtains in the homogenisation area.

13. Method according to claim 1, characterized in that the oxygen supply to the oxygen lances is so regulated that an almost constant amount and composition of synthesis gas results.

* * * * *